US007296711B2

(12) United States Patent
Hayakawa et al.

(10) Patent No.: US 7,296,711 B2
(45) Date of Patent: Nov. 20, 2007

(54) SAFETY CAP

(75) Inventors: Shigeru Hayakawa, Tokyo (JP); Takayuki Goto, Tokyo (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 308 days.

(21) Appl. No.: 10/485,250

(22) PCT Filed: Jul. 30, 2002

(86) PCT No.: PCT/JP02/07736

§ 371 (c)(1),
(2), (4) Date: Jul. 7, 2004

(87) PCT Pub. No.: WO03/011701

PCT Pub. Date: Feb. 13, 2003

(65) Prior Publication Data

US 2004/0232174 A1 Nov. 25, 2004

(30) Foreign Application Priority Data

Jul. 30, 2001 (JP) ..... 2001-230136
Jul. 31, 2001 (JP) ..... 2001-232105

(51) Int. Cl.
*B67B 5/00* (2006.01)
*B65D 5/008* (2006.01)
*B65D 41/016* (2006.01)

(52) U.S. Cl. ..... 222/153.14; 222/541.6; 222/546; 222/556; 215/209; 220/794

(58) Field of Classification Search ..... 222/153.1, 222/153.09, 153.14, 541.6, 541.9, 556, 546; 215/209, 211, 228; 220/794, 324
See application file for complete search history.

(56) References Cited

U.S. PATENT DOCUMENTS 4,629,081 A * 12/1986 McLaren ..... 215/206

(Continued)

FOREIGN PATENT DOCUMENTS

JP Y2 56-28939 7/1981

(Continued)

*Primary Examiner*—Kevin Shaver
*Assistant Examiner*—Melvin A Cartagena
(74) *Attorney, Agent, or Firm*—Oliff & Berridge, PLC

(57) ABSTRACT

A child resistant safety cap having a cover and a safety mechanism by which finger dexterity is required to open the cap, while the safety mechanism capable of being released if it is unnecessary. The cap comprises a cap body 1 having a skirt 3 with at least one stopping piece 9 at one side thereof. The stopping piece 9 has a base end fixed to a lower portion of the skirt 3 such that the stopping piece is pushable inwardly and swayable about the base end. The leading end portion of the stopping piece 9 is confronting at its outside with the insides of an outer tube 14 of the cover, and first and second engagement means 10, 18 are provided at confronting sides of the stopping piece 9 and the outer tube 14 for providing mutual engagement, such that when the stopping piece 9 is in an initial position, the first and second engagement means 10, 18 are engaged unless the stopping piece 9 is pushed inwardly against its elasticity. The stopping piece is adapted to move to a second position where the first and second engagement means are separated without pushing the stopping piece.

7 Claims, 6 Drawing Sheets

U.S. PATENT DOCUMENTS

| | | | | |
|---|---|---|---|---|
| 4,807,768 | A * | 2/1989 | Gach | 215/216 |
| 5,577,626 | A * | 11/1996 | Henkel et al. | 215/237 |
| 6,405,885 | B1 * | 6/2002 | Elliott | 215/237 |

FOREIGN PATENT DOCUMENTS

| | | |
|---|---|---|
| JP | A 9-86550 | 3/1997 |
| JP | A 10-264953 | 10/1998 |
| JP | A 2000-335610 | 12/2000 |
| JP | A 2000-335611 | 12/2000 |
| JP | B2 3273359 | 2/2002 |

* cited by examiner

SAFETY CAP

TECHNICAL FIELDS

The present invention relates to a safety cap, in particular, a safety cap with a cover unopenable unless a specific opening operation is taken place.

PRIOR ART

Conventionally, as a cap for a container for a drink or other contents, there is proposed a cap having a cylindrical body for fitting on an opened neck portion of the container, and a cover for closing the top end surface of the cylindrical body. Although such a cap is easy to open for everybody, but it may be opened by a mischief small child such that the contents of the container may be scattered therearound. Moreover, the cap is susceptible to an unauthorized opening which may result in pilfering of the contents by unauthorized persons.

For preventing these disadvantages, there are following proposals on safety caps which are not able to open without taking a specific open operation that requires the finger dexterity of the grownups.

For example, Japanese Utility Model Publication No. 56-28939 (hereinafter referred as document 1), discloses a safety cap with a ball type torque transmission. This safety cap is formed by an inner cap member screw-fitted on the opened neck portion of the container, and an outer cap member for covering the outside of the inner cap member, which is attached rotationally to the inner cap member but irremovable therefrom against pulling. The ball type torque transmission is formed between the inner and outer cap members so as to transmit the torque from one to the other when the outer cap member is rotated to a closing direction, or when the container is inclined to a certain orientation and then the outer cap member is rotated to an opening direction in the inclined state. Accordingly, when the container is not inclined to that orientation, it is impossible to detach the inner cap member from the opened neck portion of the container by the rotation of the outer cap member, since the outer cap member rotates idly around the inner cap member, transmitting no torque thereto.

Japanese Patent Application Laid-Open No. 2000-335610 (hereinafter referred as document 2) discloses a safety cap similar to the one according to the document 1, except that the ball type torque transmission is replaced by an engagement pin for penetrating through the top walls of the inner and outer cap members.

Japanese Patent Application Laid-Open No. 2000-335611 (hereinafter referred as document 3) discloses a safety cap comprising a rotation cylinder for fitting on the opened neck portion of a container irremovably, an outer cylinder with a top wall which is screw-fitted on the main part of the rotation cylinder except its lower end part, and an engagement means which is provided between the rotation cylinder and the outer cylinder for providing an engagement therebetween when the outer cylinder is turned to a closing direction, and releasing the engagement when the outer cylinder is turned to an opening direction, such that the outer cylinder turns around the rotation cylinder under the engagement releasing condition. By pushing a portion of the lower end part of rotation cylinder, on the other hand, the engagement is released such that the outer cylinder is screwed out from the rotation cylinder.

Japanese Patent Application Laid-Open No. 9(1997)-86550 (hereinafter referred to as document 4) discloses a safety cap comprising a cap body having a top wall with a discharge port and a cover hinged to a rear portion of the cap body. An U-shaped locking piece as seen from the above, is provided to a front surface of the cap body, and an operation plate is extending downwardly from a front portion of the cap body through the locking piece and having an upper plate portion for detachable engagement with the locking piece, such that the engagement is released by pushing the lower plate portion of the operation plate to the backwards.

Japanese Patent Application Laid-Open No. 10(1998)-264953 (hereinafter referred to as document 5) and Japanese Patent No. 3273359 (hereinafter referred to as document 6) disclose a safety cap comprising a cap body and a cover hinged to the rear side of the cap body, wherein a generally inverted U-shaped slit is cut in the left and right sides of the circumferential wall of the cap body except its lower end portion to form a stopping piece therein, having an upper end portion which is adapted to be engaged to the remainder of the circumferential wall of the cap body and detachable therefrom by depressing the stopping piece inwardly.

DISCLOSURE OF THE INVENTION

The proposals according to the documents 1 to 3 may only apply to the type of the safety cap for screw-fitting on the opened neck portion of the container. On the other hand, in the squeezable container for storing detergent for example, the cap having a cover hinged to its cap body is widely used for facilitating the opening and closing operation, such as disclosed in the document 4. However, since the lower plate portion of operation plate is exposed to the outside as a push button, the appearance of the cap is deteriorated and the dust is apt to be attached to the lower plate portion of the operation plate, which may be disadvantage in accordance with the usage of the cap. To improve this point, the documents 5 and 6 teach to form the stopping piece for maintaining a closing state as a part (the left and right side portions) of the circumferential wall. For opening this cap, it is necessary to press the stopping pieces inwardly of the cap and to push the front portion of the cover to rotate it into an opening direction at the same time. This operation is more complicated to some extent than that of the cap according to the document 4, i.e., pressing the lower plate portion of the operation plate inwardly and then pushing the same upwardly. Although the complexity in its operation contributes to prevent unintentional opening of the cap by the small children (including infants) for example, thereby increasing the cap' childproofness, it is natural that the grown-up user feels it troublesome especially when he or she has to repeat the opening operation for the repeated use of the container under the circumstances there is no chance of unintentional use of the children.

The first purpose of the present invention is to provide a safety cap which is useful for the adult, and also resistant to the unintentional or unauthorized use by the children for example.

In order to achieve this purpose, the present invention proposes a safety cap comprising:

a cap body having a top wall with a discharge spout, and a skirt depending from the top wall;

a cover having an outer tube which is connected to the cap body via a hinge and adapted to fit on an upper part of the skirt;

at least one stopping piece which is disposed at one side of the skirt, having a proximal end portion fixed to a lower portion of the skirt and a distal end portion, an outer surface of which is able to confront to an inner surface of the outer cylinder, the stopping piece is capable of being pushed inwardly to swing around the proximal end portion;

first and second engagement means formed on the outer surface of the distal end portion and the inner surface of the outer tube for providing mutual engagement and cooperating with each other to maintain a closed state of the cover, and for releasing the engagement by pushing the stopping piece inwardly;

wherein the stopping piece is forcibly movable from an initial position where the first and second engagement means are cooperating with each other to maintain the closed state of the cap, such that the first and second engagement means are separated each other, after being removed from the initial position, allowing an opening of the cover without pushing the stopping piece inwardly.

It is desirable that the stopping piece is formed as a portion of the skirt within an inverted U-shaped slit which is cut at one side of the cap body, so as to enable the stopping piece to swing about the proximal end portion to laterally outwardly. This feature contribute to a favorable streamlined appearance of the safety cap as mentioned previously.

It is also desirable that the skirt has a pair of stopping pieces which are diametrically opposed to each other and spaced generally equidistantly from the hinge, and that a pair of first engagement means are formed in the stopping pieces respectively, while a pair of second engagement means are formed in the outer tube of the cover corresponding to the first engagement means. In this structure, the cap is able to open only when the both sides of the cap is pressed inwardly at the same time, such that the child resistivity is improved.

Second purpose of the present invention is to provide a safety cap with a stopping piece which is movable between an initial state and a second state.

In order to achieve this purpose, the present invention proposes a safety cap according to the first purpose, wherein the stopping piece is provided at its outside with a generally U-shaped sliding member having a pair of sliding arms protruding parallel from both ends of an intermediate connecting portion for insertion into a pair of vertical portions of the inverted U-shaped slit, and a pair clicks, each of which is formed on a leading end of the sliding arm and adapted to engage with a margin within the slit on the skirt's side irremovably therefrom, such that the sliding member is adapted to move up and down with respect to the stopping piece, with the intermediate connecting portion being in contact with an outside of the stopping piece, wherein an outer surface of the stopping piece is formed into a slant surface protruding gradually outwardly from the margin within the slit, in approaching from the proximal end of the stopping piece to the distal end thereof, such that the slant surface is pressed inwardly by the intermediate connecting portion when the sliding member is pushed upwards;

the stopping piece is movable by the up-and-down movement of the sliding member between the initial position where the first and second engagement means are cooperating to maintain the closed state of the cap, and a second position where the first and second engagement means are separate from each other, and does not recover to a mutual engagement state.

The third purpose of the present invention is to provide a safety cap which is not able to recover to its initial state after opening, showing an obvious sign of the unauthorized opening particularly.

In order to achieve this purpose, the present invention proposes a safety cap according to the first or second purpose, wherein a fragile line is formed at a lower part of the stopping piece such that the stopping piece is able to cut off from the cap body so as to leave initial position by breaking the fragile line.

By the way, as a safety cap adapted to show an obvious sign of illegal opening, Japanese Patent Laid-Open No. 7-41028 teaches one having cap body, a cover, and a connecting piece formed therebetween, said connecting piece having such a break portion such that it is broken when the cap is opened. However, the cap according to the present invention is distinguished from the prior art in that the cap is opened by pressing the stopping piece inwardly, and the stopping piece is adapted to be removed from the cap only when it is necessary.

The fourth purpose of the present invention is to reduce rattling in the stopping piece of the safety cap according to the third purpose of this invention.

In order to achieve this purpose, the wherein the stopping piece is extending laterally outwardly from the fragile line when the safety cap is molded, and then turned to an upstanding condition after the molding of the safety cap against its elasticity, a pair of engagement projections are protruded from opposite sides of an upper part of the stopping piece and adapted to forcibly ride over an edge of the slit to engage with an inner surface of the skirt.

The other purposes of the present invention will be apparent from the later described best mode of the present invention.

BEST MODE OF THE INVENTION

FIGS. 1 to 6 show a first embodiment of the safety cap according to the present invention.

Figure 1:
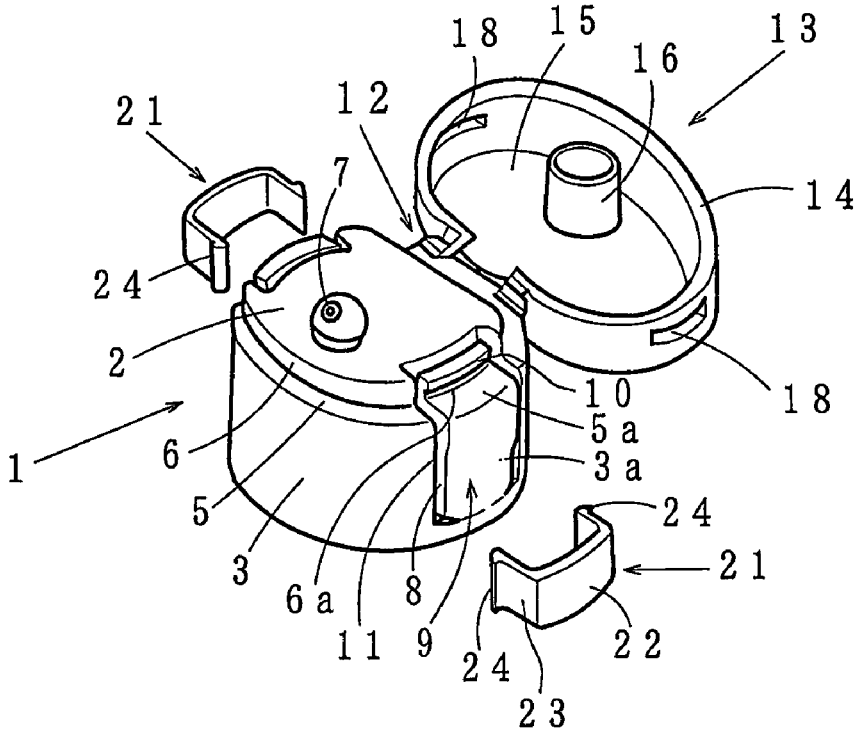
FIG. 1 is a perspective view of the safety cap according to the first embodiment of the present invention in a dissolved state.
Figure 2:
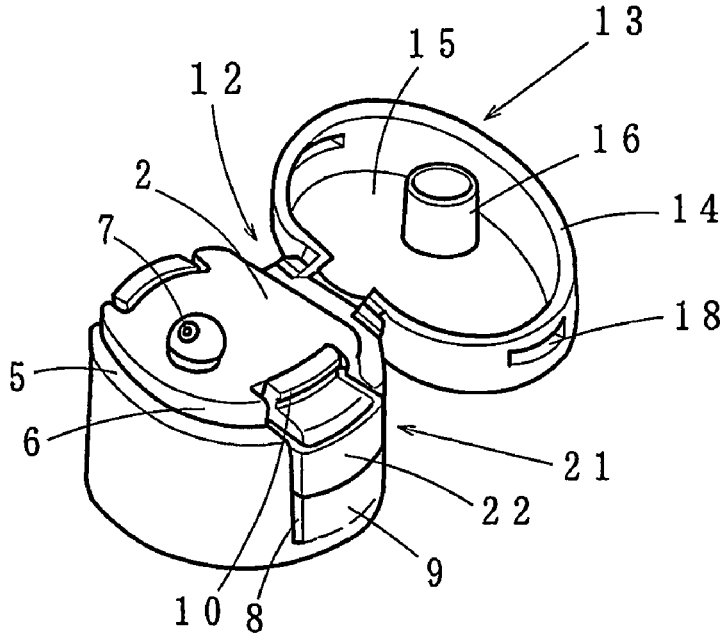
FIG. 2 is also a perspective view of the safety cap in the same embodiment when the sliding member is pushed up and its cover is opened.
Figure 3:
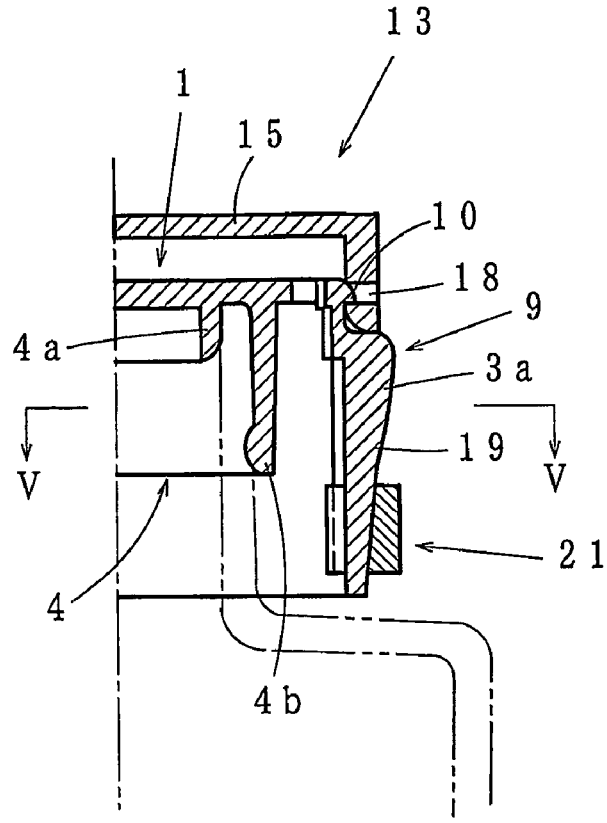
FIG. 3 is a half sectional view of the safety cap in the same embodiment when the sliding member is pushed down.
Figure 4:
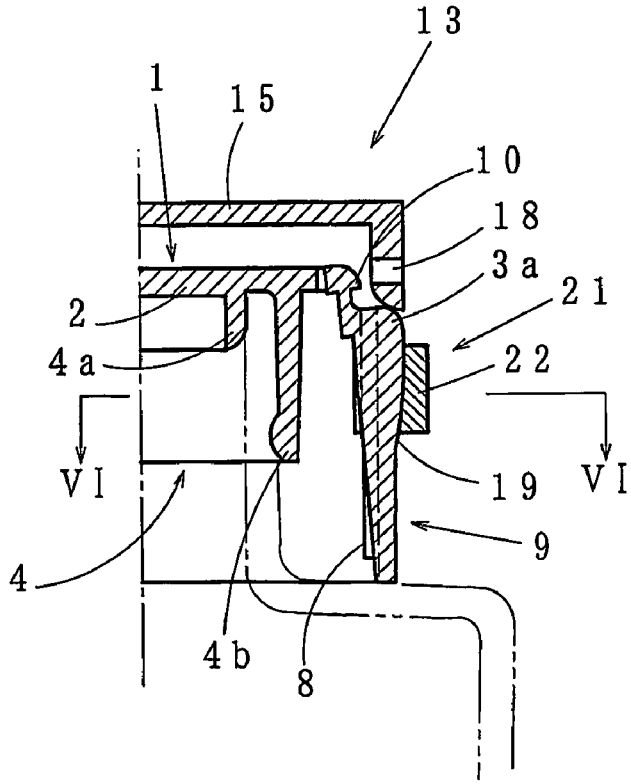
FIG. 4 is a half sectional view of the safety cap in the same embodiment when the sliding member is pushed up.
Figure 5:
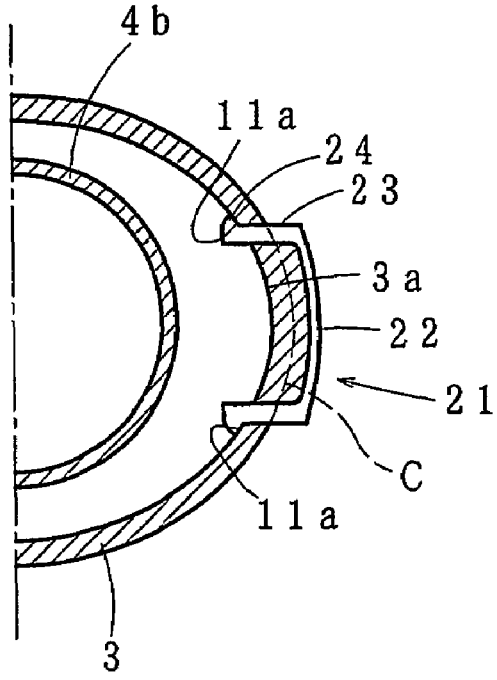
FIG. 5 is a cross sectional view of the safety cap in the same embodiment taken along a line V-V in FIG. 3.
Figure 6:
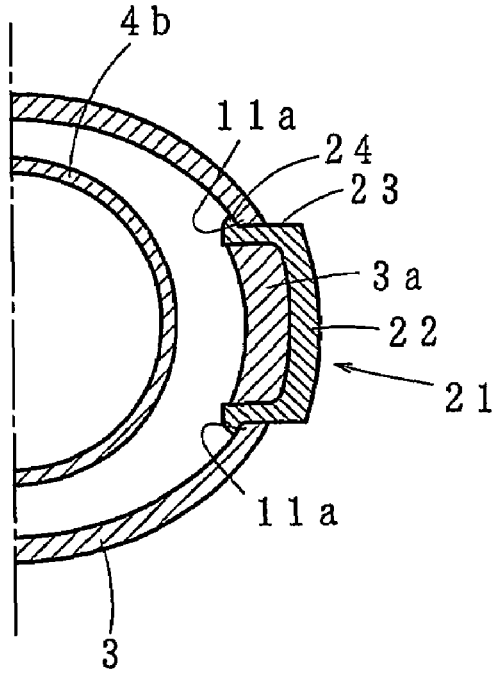
FIG. 6 is a cross sectional view of the safety cap in the same embodiment taken along a line VI-VI in FIG. 4.
Figure 7:
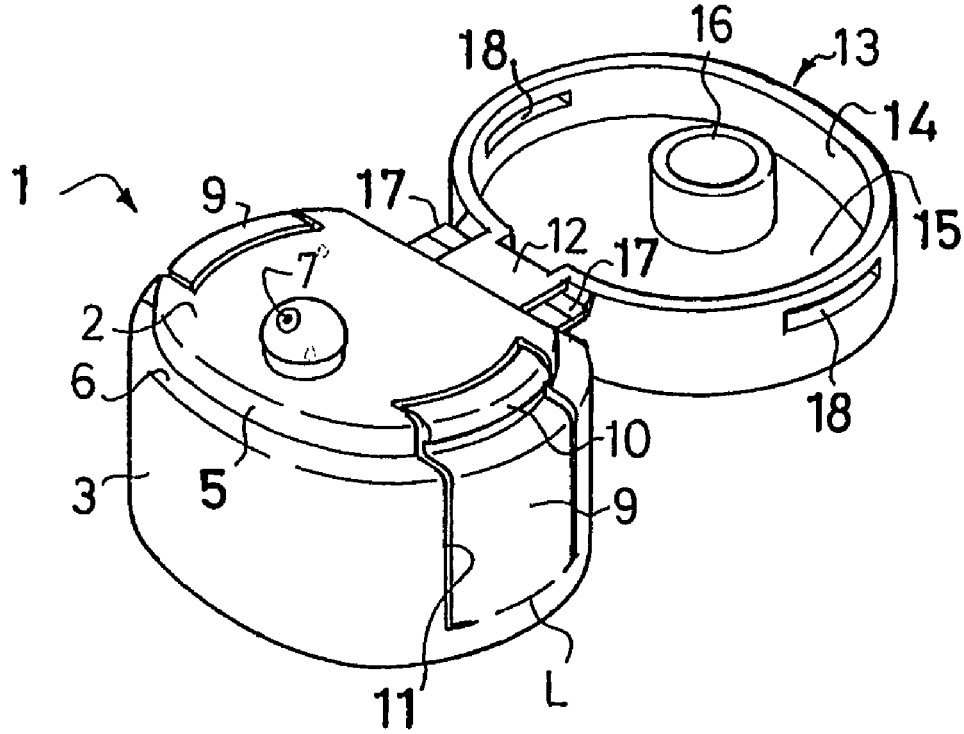
FIG. 7 is a perspective view of the safety cap according to the second embodiment of the present invention in an open state.
Figure 8:
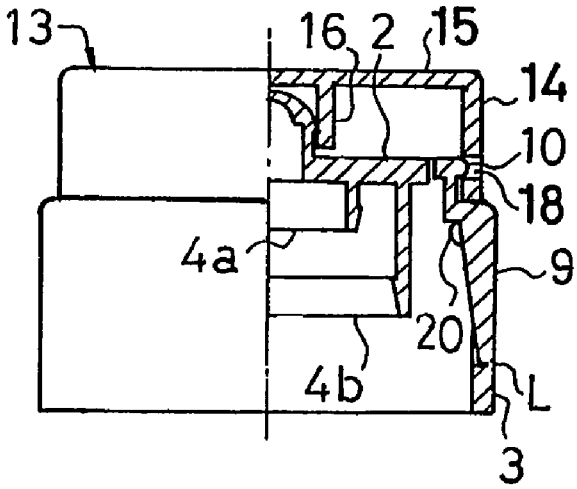
FIG. 8 is a half sectional view of the safety cap in the same embodiment.
Figure 9:
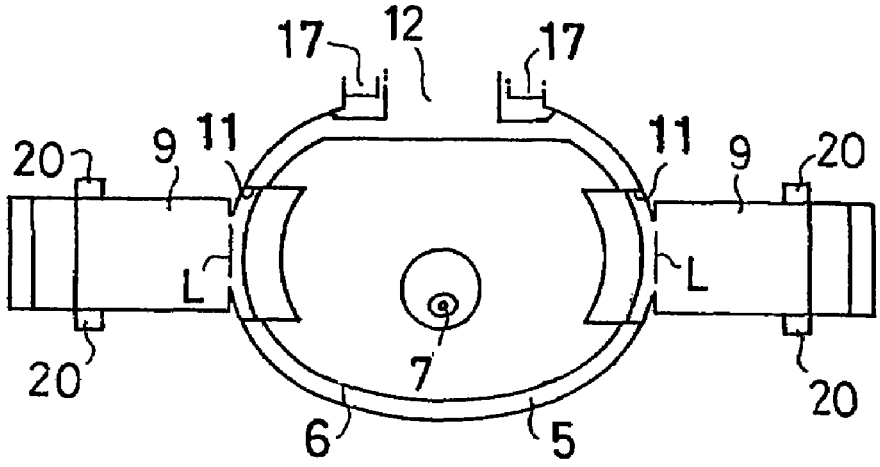
FIG. 9 is a top plan view of an essential portion of the cap body of the safety cap in the same embodiment.

Referring briefly on the elements of the safety cap which are common with the prior art. Numeral 1 designates a cap body having a top wall 2 and a skirt (or an outer circumferential wall) 3 depending from the perimeter of the top wall. The top wall 2 is provided at its under side with inner circumferential wall(s) 4 depending therefrom for fitting to an opened neck portion of a container as shown in FIGS. 3 and 4. The inner circumferential walls may be a sealing cylinder 4*a* for fitting within the opened neck portion, and a holding cylinder 4*b* for fitting on the opened neck portion. The upper end portion of the cap body 1 is preferably formed into a small diameter portion 6 with a step portion 5 with its surface directed upwardly being intermediate the upper end portion and the remainder of the cap body 1. The top wall 2 is provided at its front portion with a discharge spout 7 from which a nozzle is standing.

A stopping piece 9 is formed as a part of the cap body 1 and adapted to function as a push bottom. It is preferable that a pair of stopping pieces are provided equidistantly from a later-described hinge. In a favorable shown embodiment, each stopping piece is formed by cutting a slit (or a split groove) 8 on the left and right side portions of the skirt 3 except the lower end portion of the skirt itself, such that the surface of the stopping pieces and the remainder of the cap body except the stopping pieces are generally flush with (i.e. formed continuously with) each other. The stopping piece 9 is provided at the outside of its upper end portion with a first engagement means 10 which is a laterally formed engagement claw in this embodiment. Moreover, in a shown embodiment, the stopping piece 9 has a skirt corresponding portion 3*a* which forms a portion of the skirt, and a step corresponding portion 5*a* located above the skirt corresponding portion, and a portion 6*a* corresponding to a small outer diameter portion, formed above the step corresponding portion 5*a*. On the other hand, the slit 8 may be made wider than it is in the shown embodiment. This construction may be embodied by forming a belt-like window hole 11 from the perimeter of the top wall 2 of the cap body 11 to the lower portion of the skirt 3, and by extending the stopping piece 9 from the lower periphery of the window hole into the same. In this case, the stopping piece 9 is desirably shaped into a longitudinal plate.

An auxiliary cap 13 is attached to a rear portion of the cap body 1 through a thin hinge 12. The cap 13 has a top plate 15, an outer tube (or circumferential wall) 14 depending from the perimeter of the top plate 15 for fitting on the small outer diameter portion 6, and a sealing cylinder 16 depending from the underside of the top plate 15 for fitting with the nozzle. Upon the rotation of the auxiliary cap 13 about the hinge 12, the outer tube 14 is fitted to and removed from the small outer diameter portion 6, and the sealing cylinder 16 is fitted to and removed from the outside of the nozzle respectively. Meanwhile, the outer tube 14 is provided at its left and right sides with a pair of second engagement means 18, 18 which are engagement holes, such that the first engagement means 10,10 are engaged to the second engagement means 18,18 to prevent the opening of the cap. On the other hand, the first engagement means 10,10 may be released from the second engagement means 18,18 by pressing the upper end portions of the stopping pieces 9, 9 inwardly of the cap body 1 as shown in FIG. 4 to elastically deform these pieces, such that the cap can be opened.

The cap 13 may be a so called snap type cover which is automatically turned to a fully opened state or a closed on the both sides of an equilibrium. This type of cap is adapted to be urged toward an opening direction when it is opened to a certain angle (equilibrium), and is urged toward an closing direction when it is closed from the fully opened state to the certain angle.

In the present invention, the skirt corresponding portion 3*a* of the stopping piece 9 has a slant surface 19 defined by its outer surface. The slant surface 19 is protruding gradually outward of the inner margin of the skirt 3 at the slit 8 in proceeding from the lower end (proximal end) of the stopping piece to the outer upper end (distal end) of the same. In other words, the slant surface 19 is protruding outwardly from an outline (a circumscribed circle if the skirt is cylinder) C of the skirt 3 depicted by an imaginary line in FIG. 5. The skirt corresponding portion 3*a* of the stopping piece 9 is preferably formed gradually thicker in proceeding from the lower end to the upper end of the skirt corresponding portion 3*a* such that the outer surface thereof is formed into the slat surface. In this structure, the inside of the upper part of the skirt corresponding portion 3*a* does not protrude from the circumscribed circle of the skirt 3, such that the appearance of the safety cap is not deteriorated when it is used wile a sliding member 21 being its lowermost position.

The sliding member 21 is mounted on the cap body 1. It is preferable that the sliding member 21 is U-shaped as seen from the above as in FIG. 1, comprising a pair of sliding arms (sliding plates) 23, 23 protruding on both ends of an intermediate connecting means (transverse plate) 22. A pair of engagement projection 24,24 preferably formed longitudinally are formed at the outsides of their leading end portions of the sliding arms 23,23 respectively. The intermediate connecting means 22 is adapted to fit on the outside of the lower portion of the stopping piece 9, while the sliding arms 23, 23 extending through the slit 8 at the sides of the stopping piece 9, and the engagement projections 24, 24 resting on the edges 11*a* of the window hole, the inside of the skirt 3 along the slit 8 irremovably.

The sliding member 21 is adapted to move between a lower position and an upper position guided by the vertical portions of the slit 8. In a shown embodiment, the lower position is defined by the lower end of the skirt corresponding portion 3*a* of the stopping piece 9, and so is the upper portion defined by the upper end of the skirt corresponding portion 3*a*. When the sliding member 21 is located in the lower position, the stopping piece 9 is in the initial position where the first and second engagement means 10, 18 are cooperating each other to maintain the closed state of the safety cap unless the stopping pieces 9, 9 are pressed inwardly by the hand of the user or any instrument held by the user. By pushing up the sliding member 21 from the initial position, the slant surface 19 is pressed inwardly by the intermediate connecting means 22, such that the first engagement means 10, 10 are removed by the second engagement means 18, 18, and that the stopping piece 9 shifts from the initial position to the second position, where the cooperation of the first and second engagement 10, 18 is dissolved. Namely, the first and second engagement 10, 18 are separated each other without pressing the stopping piece 9.

In the above-mentioned construction, when the user wishes to use the cap according to this invention as a safety cap, the sliding member 21 is to be depressed to the lower position as shown in FIG. 3. In this state, the cap 13 is unable to open unless pressing the upper portions of the stopping pieces 9, 9 inwardly of the cap body, since the first and second engagement means 10,18 are engaged together. Accordingly, the children are not able to open the cap.

For releasing the safety function of the cap, the sliding member 21 is to be lift up to the upper position. As a result, the stopping pieces 9, 9 are pressed inwardly, with the stopping pieces to achieve the second position of the cap, such that the first and second engagement means 10,18 are normally separated and the cap is opened and closed without operation of the stopping pieces 9, 9.

FIGS. 7 to 12 shows a second embodiment of the safety cap according to the present invention. Hereinafter, the explanation on the construction equivalent to that of the first embodiment, designating by the same numeral.

In the second embodiment, the stopping piece 9 is capable of being torn off (or cut off) from the cap body 1, such that the tearing operation releases the stopping piece 9 from the initial position where the first and second engagement means 10, 18 are cooperating to maintain the closed state. Namely, corresponding to the second position in the first embodiment, the stopping piece 9 is separated completely from the cap body 1, being transferred to an arbitrary position where the first and second engagement means 10, 18 are released from cooperative relationship and does not recover its mutual engagement elastically as they do in the first embodiment.

The stopping piece 9 tearable from the cap body 1 may be embodied in many ways, for example by forming a thin weaken line or partly-cut line as a breaking line L in the cap body 1. These weaken line or partly-cut line are formed at the lower end of the stopping piece 9 in the shown embodiment, but they may be formed at any other suitable place.

The stopping piece 9 is provided at its upper portion with an engagement projection(s) 20 which protrudes laterally from one side thereof and is adapted to engage with the inside of the skirt 3 after riding it over. The engagement projection 20 prevents the stopping piece 9 from inclining outwardly, but allows inward thrusting of the stopping piece 9 for releasing the engagement of the first and second engagement means 10, 18.

Figure 10:
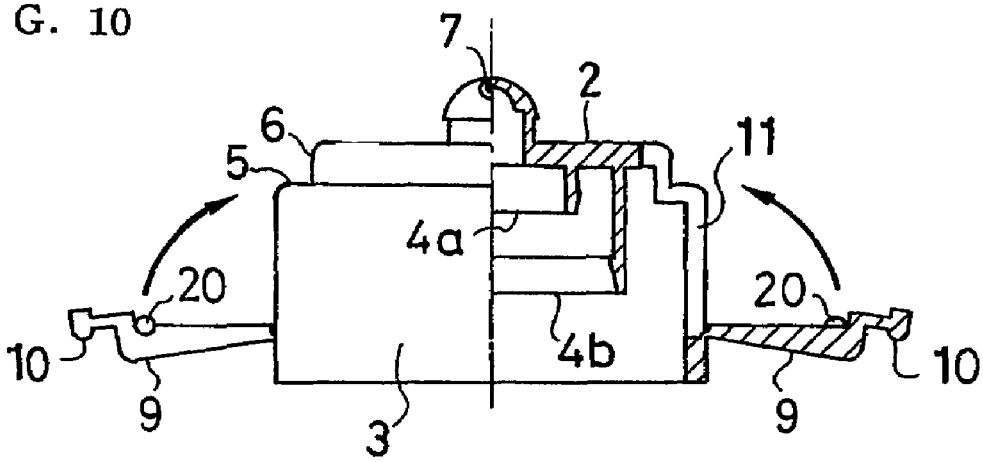
FIG. 10 is a half sectional view of the safety cap in the same embodiment before it is assembled.
Figure 11:
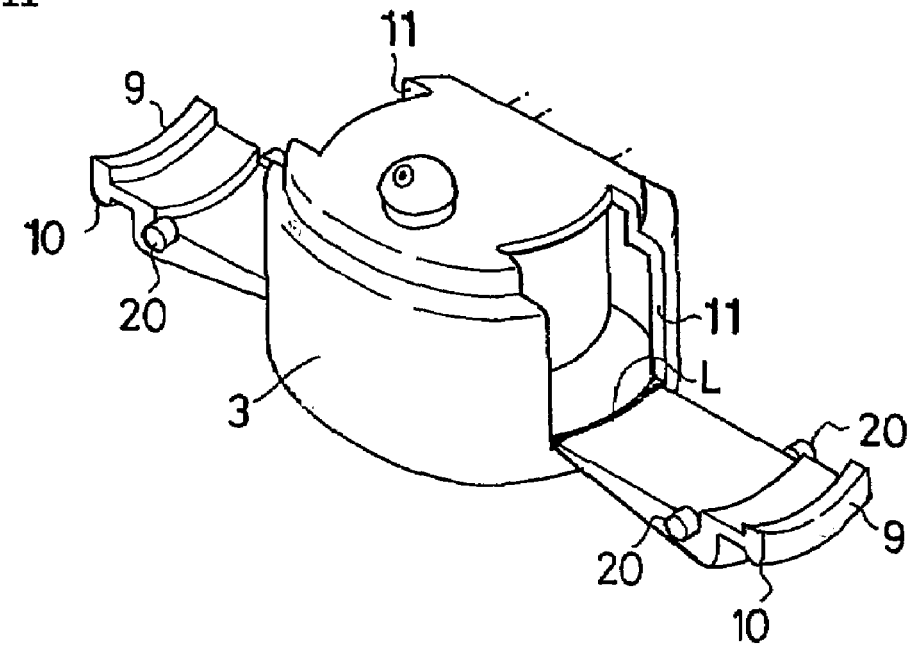
FIG. 11 is a perspective view of an essential portion of the safety cap in the same embodiment when the stopping pieces are unfolded.
Figure 12:
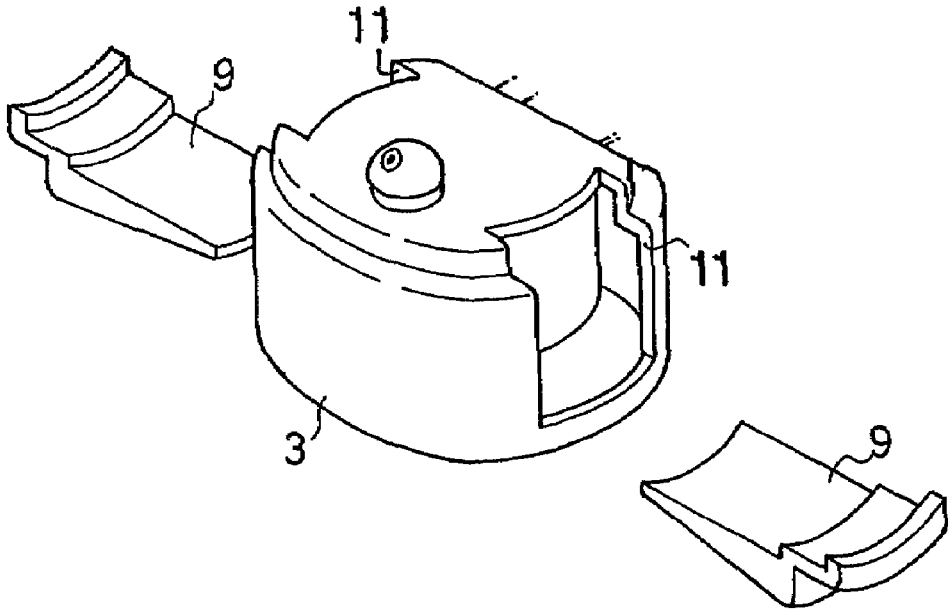
FIG. 12 is a perspective view of the essential portion of the safety cap in the same embodiment after the stopping pieces are separated.

When forming the cap body 1 as mentioned above, it is molded in a state that the stopping piece 9 is laid laterally outward of the skirt 3, and after the molding the stopping piece 9 is turned to an upright posture against its elasticity, as shown in FIG. 10 and the engagement projections 20, 20 ride over the skirt 3 to engage therewith. In this structure, each stopping piece 9 is usually urged to turn outwardly, the engagement projections 20, 20 are engageably stopped, so as to prevent the rattling of the stopping pieces 9.

Meanwhile, numerals 17, 17 designate a pair of elastic plates positioned at both sides of the hinge 12 for connecting the lower end of the outer tube 14 and the upper end of the cap body 1 at their respective rear portions.

The cap according to this embodiment can be used by pressing both of the stopping pieces 9, 9 inwardly for releasing the first engagement means 10 from the second engagement means 18, and then opening the cap 13 for distributing the liquid, as it does in the first embodiment. The cap is sufficiently resistant to the children's use or the unauthorized use, because the opening of the cap requires to release the engagement of the first and second engagement means 10, 18, and to take the opening operation of the cover 3 while keeping the unengaged state of the first and second engagement means 10, 18. After the use of the cap, the cap 13 can be closed by fitting the first and second engagement means 10, 18.

Moreover, when there is no room for the unauthorized use of the cap, the engagement projections 20, 20 are to be rode over the inner edge 11*a* of the window hole to pull the stopping piece 9 out of the cap body 1, such that the stopping pieces 9, 9 may be torn off from the cap body. After that the cap can be opened immediately.

Meanwhile, the sliding member 21 in the first embodiment and the breaking line L for tearing off the stopping piece are functionally different, but it is possible to form both of the sliding member 21 and breaking line in the stopping pieces in one safety cap.

The invention claimed is:

1. A safety cap comprising:

a cap body having a top wall with a discharge spout, and a skirt depending from the top wall;

a cover having an outer tube which is connected to the cap body via a hinge and adapted to fit on an upper part of the skirt;

at least one stopping piece which is disposed at one side of the skirt, having a proximal end portion fixed to a lower portion of the skirt and a distal end portion, an outer surface of the distal portion being able to confront to an inner surface of the outer tube, the stopping piece is capable of being pushed inwardly to swing around the proximal end portion;

first and second engagement means formed on the outer surface of the distal end portion and the inner surface of the outer tube, for providing mutual engagement and cooperating with each other to maintain a closed state of the cover, and for releasing the engagement by pushing the stopping piece inwardly; and a sliding member which is generally U-shaped and is provided at an outer surface of the stopping piece, wherein the stopping piece is formed as a portion of the skirt within an inverted U-shaped slit which is cut at one side of the cap body from a perimeter of the top wall into the skirt except a lower end portion of the skirt so as to enable the stopping piece to swing about the proximal end portion to laterally outwardly, wherein the sliding member has an intermediate connecting portion from both ends of which a pair of sliding arms are protruding parallel for insertion into a pair of vertical portions of the inverted U-shaped slit, and a pair of clicks, one formed on a leading end of each sliding arm, and adapted to engage with a margin within the slit on the skirt side irremovably from the slit such that the sliding member is adapted to move up and down with respect to the stopping piece, with the intermediate connecting portion being in contact with the outer surface of the stopping piece, wherein the outer surface of the stopping piece is formed into a slant surface protruding gradually outward from the margin within the slit in proceeding from the proximal end of the stopping piece to the distal end of the stopping piece such that the slant surface is pressed inwardly by the intermediate connecting portion when the sliding member is pushed upwards, and wherein the stopping piece is movable by the up-and-down movement of the sliding member between an initial position where the first and second engagement means are cooperating to maintain a closed state of the cap, and a second position where the first and second engagement means are separate from each other, and does not recover to a mutual engagement state.

2. A safety cap according to claim 1, wherein the skirt has a pair of stopping pieces which are diametrically opposed to each other and spaced generally equidistantly from the hinge, and that a pair of first engagement means are formed in the stopping pieces, while a pair of second engagement means are formed in the outer tube of the cover corresponding to the first engagement means.

3. A safety cap according to claim 1, wherein a small outer diameter portion is defined by an upper end portion of the cap body, which is extending upwardly from the skirt with a step portion being intermediate between the upper end portion and the skirt, and the small diameter portion is formed by an upper end portion of the stopping piece and an upper end of a reminder of the skirt except for the stopping piece, which are contoured complementary and generally continuously to each other, and the outer tube is adapted to fit on the small outer diameter portion.

4. A safety cap according to claim 1, wherein the stopping piece is gradually increasing in a thickness from the proximal end to the distal end.

5. A safety cap comprising:

a cap body having a top wall with a discharge spout, and a skirt depending from the top wall;

a cover having an outer tube which is connected to the cap body via a hinge and adapted to fit on an upper part of the skirt;

at least one stopping piece which is disposed at one side of the skirt, having a proximal end portion fixed to a lower portion of the skirt and a distal end portion, an outer surface of the distal end portion being able to confront to an inner surface of an outer cylinder, the stopping piece is capable of being pushed inwardly to swing around the proximal end portion; and first and second engagement means formed on the outer surface of the distal end portion and the inner surface of the outer tube, for providing mutual engagement and cooperating with each other to maintain a closed state of the cover, and for releasing the engagement by pushing the stopping piece inwardly, wherein a fragile line is formed at a lower part of the stopping piece such that the stopping piece is able to cut off from the cap body by breaking the fragile line, such that the first and second engagement means are separated from each other, allowing an opening of the cover without pushing the stopping piece inwardly.

6. A safety cap according to claim 5, wherein the stopping piece is formed as a portion of the skirt, within an inverted U-shaped slit which is cut at one side of the cap body from a perimeter of the top wall into the skirt except a lower end portion of the skirt, so as to enable the stopping piece to swing about the proximal end portion to laterally outwardly.

7. A safety cap according to claim 5, wherein the stopping piece is extending laterally outwardly from the fragile line when the safety cap is molded, and then turned to an upstanding condition after the molding of the safety cap against its elasticity, a pair of engagement projections are protruded from opposite sides of an upper part of the stopping piece and adapted to forcibly ride over an edge of the slit to engage with an inner surface of the skirt.

* * * * *